US005915468A

United States Patent [19]

Inoue et al.

[11] Patent Number: 5,915,468

[45] Date of Patent: Jun. 29, 1999

[54] HIGH-TEMPERATURE GENERATOR

[75] Inventors: Naoyuki Inoue; Teiichi Mochizuki, both of Fujisawa; Motonao Kera, Tokyo, all of Japan

[73] Assignee: Ebara Corporation, Tokyo, Japan

[21] Appl. No.: 08/842,572

[22] Filed: Apr. 15, 1997

[30] Foreign Application Priority Data

Apr. 17, 1996 [JP] Japan ..... 8-120936

[51] Int. Cl.[6] ..... F28F 13/00; F22B 37/24

[52] U.S. Cl. ..... 165/134.1; 165/146; 165/910; 122/367.3; 122/DIG. 13

[58] Field of Search ..... 165/134.1, 146, 165/910; 122/DIG. 13, 367.1, 367.3

[56] References Cited

U.S. PATENT DOCUMENTS

| | | | |
|---|---|---|---|
| 1,782,829 | 11/1930 | Nash et al. | 165/134.1 X |
| 1,994,198 | 3/1935 | Morterud | 165/134.1 X |
| 2,153,942 | 4/1939 | Spalding, Jr. | 165/134.1 X |
| 3,610,207 | 10/1971 | Ruhe | 122/7 R |
| 4,494,485 | 1/1985 | Kendall et al. | 122/250 R |

*Primary Examiner*—Allen Flanigan
*Attorney, Agent, or Firm*—Armstrong, Westerman, Hattori, McLeland & Naughton

[57] ABSTRACT

A generator which can prevent deterioration of the chilling performance and corrosion, and can provide a high degree of reliability and long service life is disclosed. The high-temperature generator comprises a combustion chamber for flowing a combustion gas therein, a first tube assembly and a second tube assembly provided in the combustion chamber each of which has a plurality of heat transfer tubes for containing liquid therein. The first tube assembly comprises a plurality of bare tubes and is arranged at an upstream of the second tube assembly. The second tube assembly comprises a plurality of finned tubes provided with fins on the outer surface thereof. The heat transfer tubes are arranged in a staggered manner in a direction of the combustion gas flow within each of the first tube assembly and the second tube assembly. The bare tubes and the finned tubes are arranged aligned to each other in a direction of the combustion gas flow at a boundary area between the first tube assembly and the second tube assembly.

3 Claims, 3 Drawing Sheets

HIGH-TEMPERATURE GENERATOR

BACKGROUND OF THE INVENTION

1. Field of the Invention

The present invention relates to a high-temperature generator for use, for example, in an absorption chiller heater.

2. Description of the Related Art

FIGS. 3 and 4 are schematic illustrations of a conventional high-temperature generator used in an absorption chiller heater for heating an absorption liquid. FIG. 3 is a vertical cross sectional view and FIG. 4 is a horizontal cross sectional view taken along the line A—A of FIG. 3. As shown in FIGS. 3 and 4, the conventional high-temperature generator has a combustion chamber 2 defined in a flue 2*a* in which a burner 1 is provided at an end thereof.

In the combustion chamber 2, a tube assembly is provided, which includes a bare tube assembly 3 and a finned tube assembly 4 arranged at a downstream of a combustion gas 12 emanating from the burner 1. The bare tube assembly 3 is comprised of bare tubes 31, i.e., heat transfer tubes without fins, extending vertically so as to communicate the upper and lower spaces out of the flue 2*a*. The bare tubes 31 are arranged in a staggered manner or in a zigzag manner in the gas flow direction for a high efficiency heat exchange with the combustion gas 12. That is, the tubes of the adjacent rows are arranged offset relative to each other in the gas flow direction. The finned tube assembly 4 is comprised of finned tubes 41 extending vertically and arranged in a staggered manner in the gas flow direction. Each finned tube 41 has fins 41*a* on the outer surface thereof.

The flue 2*a* for defining the combustion chamber 2 is surrounded by a pipe shell 6. Between the pipe shell 6 and the flue 2*a*, there is defined a liquid space 5 in which liquid to be heated is introduced. The pipe shell 6 has an inlet 7 in the bottom, an outlet 8 at the upper area of the side wall and the refrigerant vapor outlet 9 at the top. In the upper portion of the liquid space 5, a gas-liquid separation space 10 is defined comprising a baffle 11.

In the high-temperature generator described above, the combustion gas 12 in the combustion chamber 2 exchanges heat with the liquid within the liquid space 5 through the flue 2*a*. The heat is transferred mainly by radiation and convection to the flue 2*a*. Then the combustion gas 12 flows to the bare tubes 3 and the finned tubes 4 to exchange heat with the liquid therein. The absorption liquid is heated through the flue 2*a*, the bare tubes 3 and the finned tubes 4, and is separated into refrigerant vapor and condensed absorbent, which are discharged from the refrigerant vapor outlet 9 and the absorbent outlet 8, respectively.

However, the conventional high-temperature generator has the following disadvantage. Since the bare tubes 31 and the finned tubes 41 are arranged in a staggered manner uniformly, the combustion gas 12 having passed through the bare tube assembly 3 flows to directly hit the finned tubes 41 arranged in a first row of the finned tube assembly 4. This may cause a local overheat of the finned tubes 41 in the first row, which is enhanced because the finned tubes 41 have a large outer surface area due to the fins 41*a* provided thereon. The local overheat of the outer surface causes a more intensive local overheat of the internal wall of the finned tube 41 compared to that of the bare tube 31. The local overheat of the finned tubes 41 may result in a generation of incondensible gas to lead to the deterioration of the chilling performance as well as to corrosion.

SUMMARY OF THE INVENTION

It is therefore an object of the present invention to provide a generator which can prevent deterioration of the chilling performance and corrosion, and can provide a high degree of reliability and long service life.

According to the present invention, there is provided a high-temperature generator comprising: a combustion chamber for flowing a combustion gas therein, a first tube assembly and a second tube assembly provided in the combustion chamber each of which has a plurality of heat transfer tubes for containing liquid therein, the first tube assembly comprising a plurality of bare tubes and being arranged at an upstream of the second tube assembly, the second tube assembly comprising a plurality of finned tubes provided with fins on the outer surface thereof, wherein the heat transfer tubes are arranged in a staggered manner in a direction of the combustion gas flow within each of the first tube assembly and the second tube assembly, and the bare tubes and the finned tubes are arranged aligned to each other in a direction of the combustion gas flow at a boundary area between the first tube assembly and the second tube assembly.

DETAILED DESCRIPTION OF THE PREFERRED EMBODIMENT

Figure 1:
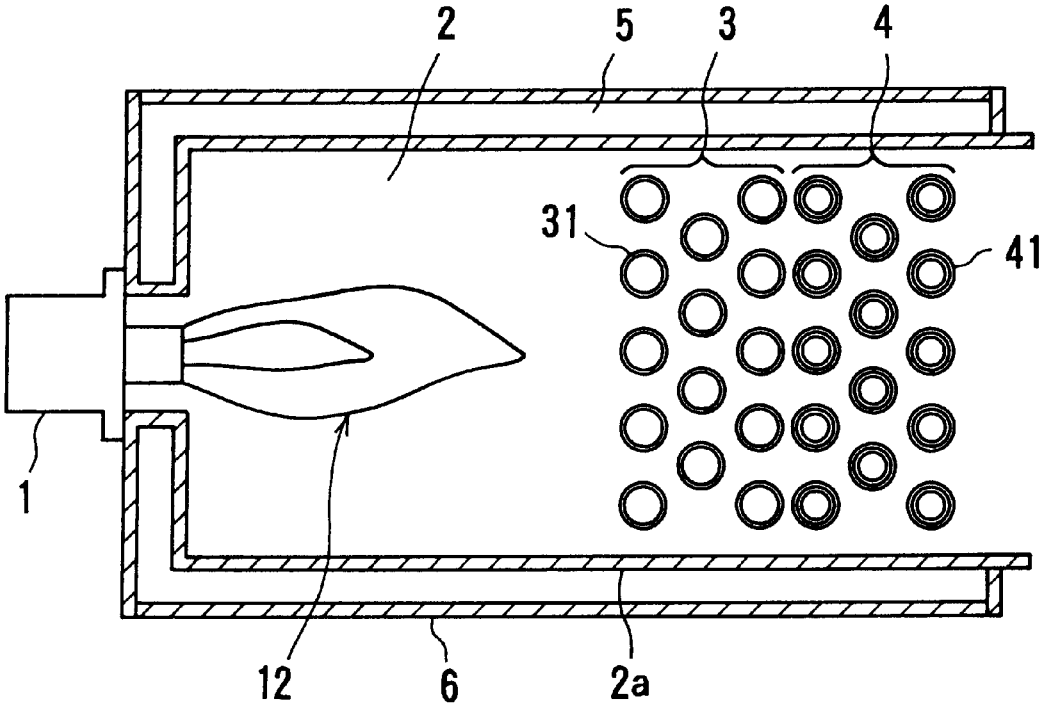
FIG. 1 is a horizontal cross sectional view showing a generator of the present invention.

Hereinafter, a preferred embodiment of the present invention will be described in detail, referring to the attached drawings. In the following description, the same features previously described will be denoted by the same reference numerals.

Figure 2:
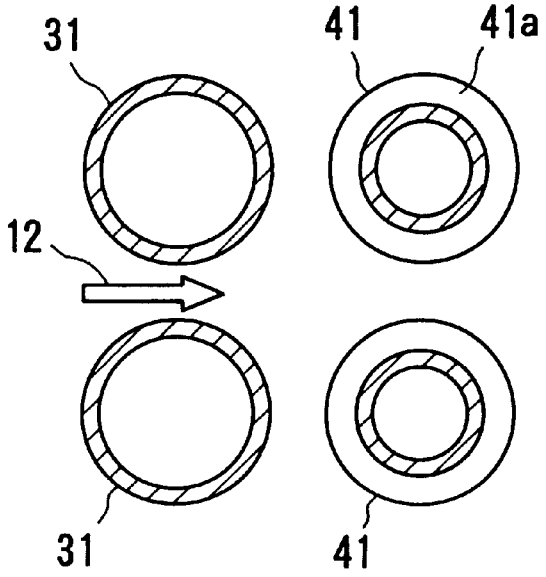
FIG. 2 is an enlarged horizontal cross sectional view showing a boundary area between the bare tube assembly and the finned tube assembly in the generator of the present invention.
Figure 3:
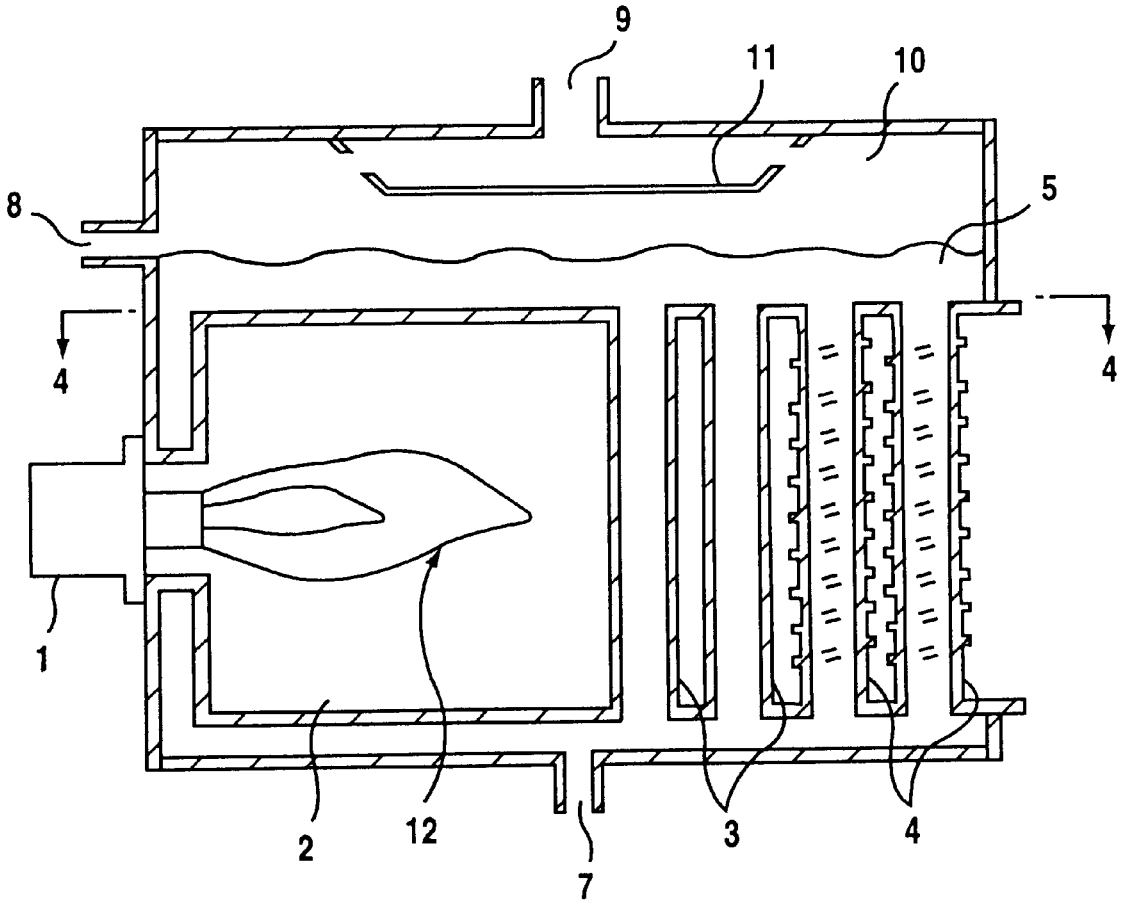
FIG. 3 is a vertical cross sectional view showing a conventional generator.
Figure 4:
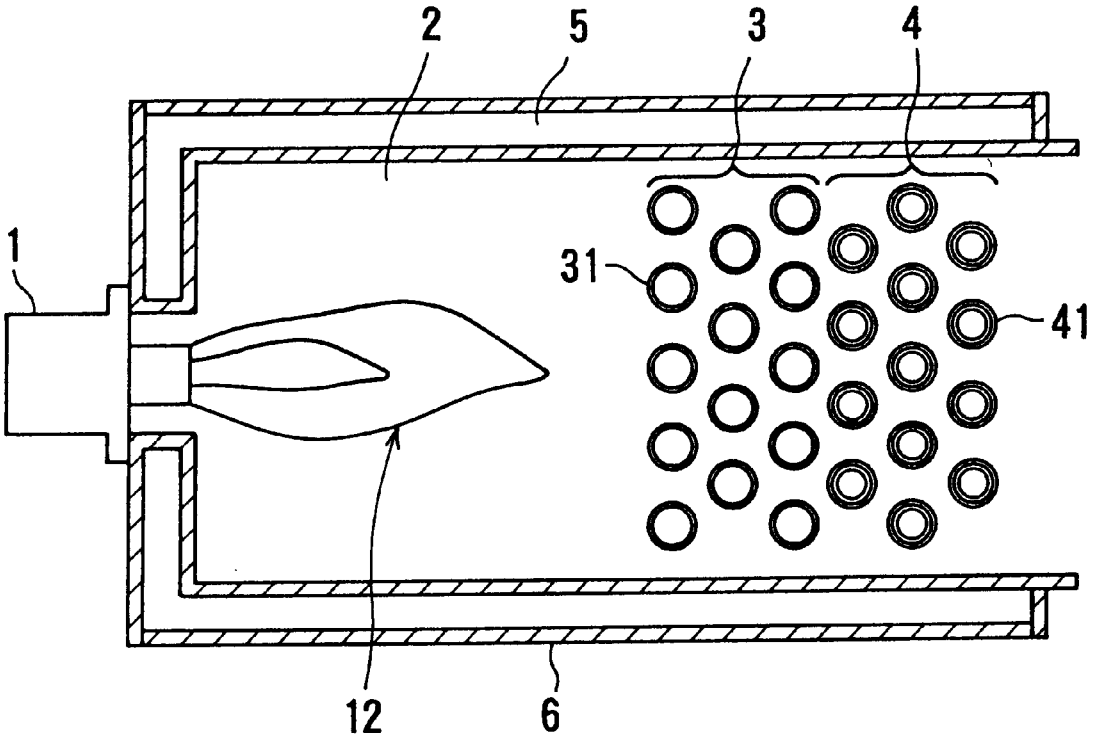
FIG. 4 is a horizontal cross sectional view taken along the line A—A of FIG. 3.
Figure 5:
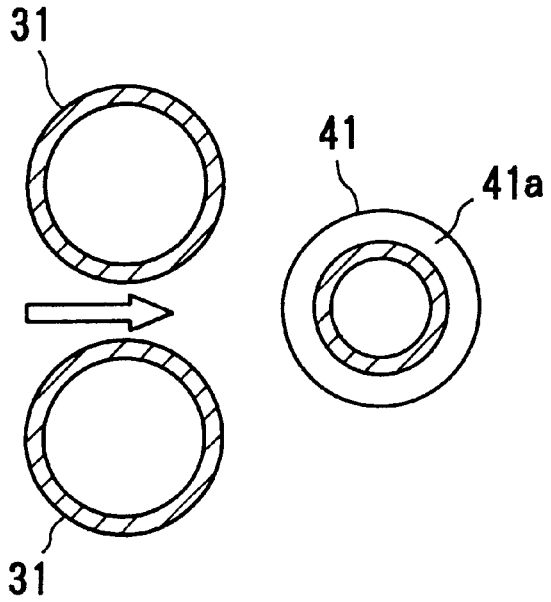
FIG. 5 is a horizontal cross sectional view showing a boundary area between the bare tube assembly and the finned tube assembly.

As shown in FIGS. 1 and 2, the high-temperature generator of the present invention has a combustion chamber 2 defined within a flue 2*a* in which a burner 1 is provided at an end thereof. In the combustion chamber 2, a tube assembly is provided at a downstream of the combustion gas 12 emanating from the burner 1, which includes a bare tube assembly 3 and a finned tube assembly 4. Each of the tube assemblies 3, 4 comprises a plurality of heat transfer tubes 31, 41 arranged vertically and in three rows. The bare tube assembly 3 has a plurality of bare heat transfer tubes 31, and the finned tube assembly 4 has a plurality of finned tubes 41 which are both arranged in a staggered manner along the combustion gas flow direction within each tube assembly 3, 4.

At the boundary area between the bare tube assembly 3 and the finned tube assembly 4, the bare tubes 31 and the finned tubes 41 are aligned along the combustion gas flow direction. In other words, each finned tube 41 in the first row of the finned tube assembly 4 is arranged directly behind each corresponding bare tube 31 in the last row of the bare tube assembly 31 in the gas flow direction.

According to the above described arrangement of the bare tubes 31 and the finned tubes 41 at the boundary area, most of the combustion gas 12 having passed through between the bare tubes 31 of the last row of the bare tube assembly 3 then flows through between the finned tubes 41 in the first row of the finned tube assembly 4, as shown in FIG. 2.

Since the finned tubes 41 in the first row of the finned tube assembly 4 is covered behind the bare tubes 31 of the last row of the bare tube assembly 3, the combustion gas 12 does not hit straight the finned tubes 41 in the first row, and does not cause the local overheat of the finned tubes 41 in the first row. Accordingly, the generator of the present invention does not cause deterioration of the chilling performance or the accidental corrosion, and can provide a highly reliable high-temperature generator with a long service life.

The combustion gas 12 after passing through the first row of the finned tube assembly 4 then hits the finned tubes 41 in the second row of the finned tube assembly 4. However, the combustion gas 12 having passed through the first row of the finned tube assembly 4 has already exchanged heat with the fins 41*a* on the fin tubes 41 of the first row of the finned tube assembly 4 and had its temperature decreased, the local overheat is far less intensive compared to that of the conventional high-temperature generator.

Although the bare tube assembly 3 and the finned tube assembly 4 are provided on the downstream side of the combustion gas 12 in the combustion chamber 2 in the embodiment, it is permissible to provide the tube assemblies 3, 4 much closer to the burner 1 so that the combustion is carried out around the bare tube assembly 3. Also, in the above embodiment, the finned tubes 41 of the first row are arranged directly behind the bare tube 31 of the last row of the bare tube assembly 3. However, the arrangement of the bare tubes 31 and the finned tubes 41 may be deviated from the tight alignment in the combustion gas flow direction within a range where the finned tubes 41 of the first row are substantially covered by the last bare tubes 31 for providing the benefits of the present invention.

Although certain preferred embodiments of the present invention have been shown and described in detail, it should not be construed to limit the scope of the invention. It should be understood that various changes and modifications may be made therein without departing from the scope of the appended claims.

What is claimed is:

1. A high-temperature generator comprising:

a combustion chamber for flowing a combustion gas therein, a first tube assembly and a second tube assembly provided in said combustion chamber each of which has a plurality of heat transfer tubes for containing liquid therein, said first tube assembly comprising a plurality of bare tubes and being arranged at an upstream of said second tube assembly, said second tube assembly comprising a plurality of finned tubes provided with fins on the outer surface thereof, wherein said heat transfer tubes are arranged in a staggered manner in a direction of said combustion gas flow within each of said first tube assembly and said second tube assembly, and said bare tubes and said finned tubes are arranged aligned to each other in a direction of said combustion gas flow at a boundary area between said first tube assembly and said second tube assembly.

2. A high-temperature generator according to claim 1, wherein an outer diameter of said bare tubes and an outer diameter of said fins are substantially equal.

3. A generator according to claim 1, wherein each of said first tube assembly and said second tube assembly comprises a plurality of said heat transfer tubes arranged in a plurality of rows and said finned tubes in the first row in said second tube assembly is arranged directly behind the bare tubes of the last row of said first tube assembly.

* * * * *